US005456318A

United States Patent [19]

Priestly

[11] Patent Number: 5,456,318

[45] **Date of Patent: * Oct. 10, 1995**

[54] FLUID PUMPING APPARATUS AND METHOD OF PUMPING FLUID

[75] Inventor: Ronald A. Priestly, Longview, Tex.

[73] Assignee: Fluid Masters Inc., Kilgore, Tex.

[ * ] Notice: The portion of the term of this patent subsequent to May 24, 2011 has been disclaimed.

[21] Appl. No.: 225,587

[22] Filed: Apr. 11, 1994

Related U.S. Application Data

[63] Continuation of Ser. No. 975,686, Nov. 12, 1992, Pat. No. 5,314,025.

[51] Int. Cl.[6] ..... F21B 43/00; F04B 21/02

[52] U.S. Cl. ..... 166/369; 166/105; 417/415; 417/417

[58] Field of Search ..... 166/68, 68.5, 105, 166/106, 108, 369; 417/56, 60, 415, 417, 418, 554

[56] References Cited

U.S. PATENT DOCUMENTS

| | | | |
|---|---|---|---|
| 530,350 | 12/1894 | Rosenkranz | 277/62 |
| 1,624,798 | 4/1927 | Neilson | 277/120 |
| 1,679,625 | 8/1928 | Penrod et al. | 166/105.4 |
| 3,075,474 | 1/1963 | Kelley | 417/554 |
| 3,802,802 | 4/1974 | Greer | 417/98 |
| 4,047,853 | 9/1977 | Huckaby | 417/554 X |
| 4,492,536 | 1/1985 | Gilbertson | 417/401 |
| 4,501,119 | 2/1985 | Stanton | 60/398 |
| 4,538,970 | 9/1985 | Rabson | 417/417 |
| 4,548,552 | 10/1985 | Holm | 417/417 |
| 4,611,974 | 9/1986 | Holland | 417/388 |
| 4,781,543 | 11/1988 | Sommer | 417/378 |
| 4,841,846 | 6/1989 | Grambling | 92/60 |
| 4,871,302 | 10/1989 | Clardy et al. | 414/404 |
| 4,874,294 | 10/1989 | Karg | 417/12 |
| 4,921,407 | 5/1990 | Ponder | 417/553 |
| 5,040,608 | 8/1991 | Doan | 417/554 X |
| 5,058,667 | 10/1991 | Ramsower | 166/105 X |

*Primary Examiner*—David J. Bagnell

*Attorney, Agent, or Firm*—Haynes and Boone; Jeffrey M. Becker; Michael D. Pegues

[57] ABSTRACT

A fluid pumping apparatus for producing fluid from a well through production tubing comprises an elongate hollow body to be disposed in a well bore and at least partially submerged in fluid to be produced from the well, the body including a fluid inlet valve at its lower end for flow of fluid into the body, a plunger assembly disposed in the interior of the body for reciprocating movement relative thereto, sealing means cooperating with the plunger assembly to divide the body into isolated lower and upper chambers and to isolate the body from the production tubing, and fluid flow control valves operationally synchronized so that fluid is forced up the production tubing upon downstroke of the reciprocating plunger assembly in the body of the pumping apparatus. A method of pumping fluid utilizing the apparatus of the invention to produce fluid on the downstroke of the plunger assembly is also provided.

14 Claims, 3 Drawing Sheets

FLUID PUMPING APPARATUS AND METHOD OF PUMPING FLUID

CROSS REFERENCE TO RELATED APPLICATION

This application is a continuation of Ser. No. 07/975,686 filed Nov. 12, 1992, now U.S. Pat. No. 5,314,025 issued May 24, 1994.

FIELD OF THE INVENTION

The present invention generally relates to fluid pumping apparatus, and in at least some of its embodiments more specifically relates to reciprocating pump apparatus to be placed at a production zone in a well casing for pumping fluid to the surface upon each downstroke of the pumping apparatus.

BACKGROUND OF THE INVENTION

The use of longitudinally reciprocating pumps to raise fluid from a well to the surface is long standing and is generally well known in the prior art. It is typical for a well from which fluid, such as water or crude oil, is to produced to be completed with a cylindrical casing extending from the surface downward to a fluid-containing zone from which fluid is to be drawn. The casing defines the well bore and is typically perforated at the production zone to allow fluid to flow into the casing. Pumps known in the prior art typically include an elongate string of production tubing extending down the casing, with a pump body at the lower end of the tubing, typically activated by an elongate string of rods extending through the interior of the tubing. A reciprocating pumping action is utilized to lift fluid from the pump body up the production tubing upon each upstroke of the apparatus. While effective in the sense of moving fluid up the production tubing to the surface, there are significant disadvantages and inefficiencies associated with pumps previously known in the art.

In many instances, the fluid to be produced is located a substantial distance below the surface, so that the weight of the activation rods, typically referred to as "sucker rods," and pump is also substantial. Since prior art pumps move fluid toward the surface by lifting the fluid on the upstroke of the pump apparatus, it is necessary to lift not only the weight of the column of fluid, but also the weight of the sucker rods and reciprocating pump components on each production stroke. With prior art pump designs no fluid production occurs on the downstroke, which serves only to lower the apparatus for another upstroke. The lifting of the weight of the reciprocating production apparatus on each production stroke is inefficient and directly wasteful of energy, since energy associated with downward movement of the pumping apparatus on each downstroke is not utilized for any productive purpose.

There remains a need for a pumping apparatus for production of fluid from a well that efficiently utilizes the energy available for fluid production to the surface. Accordingly, it is among the objects of the invention to provide a pumping apparatus without the inefficiencies and disadvantages of the prior art. It is also among the objects of the invention to provide a pumping apparatus that utilizes the energy added to the pumping apparatus during upstroke to produce fluid on the downstroke. It is further among the objects of the invention to utilize the weight of the sucker rods and reciprocating pump apparatus and its movement in response to gravity as a source of pumping energy. It is additionally among the objects of the invention to provide a self-adjusting sealing means between reciprocating pump components and stationary pump components to automatically compensate for wear.

SUMMARY OF THE INVENTION

The apparatus of the invention is useful for the production of any fluid that must be pumped from a well, including production of crude oil from oil wells and production of water from water wells. A typical well production installation with which the apparatus may be used generally includes an elongate cased well bore extending from the surface to a geological strata or zone at which the desired fluid is present, an elongate string of hollow production tubing extending from the surface down the interior of the well casing to the fluid zone, a pump apparatus connected to the lower end of the production tubing, an elongate string of pump activating rods, or sucker rods, extending through the interior of the production tubing, and a pump driver at the surface to raise and lower the string of sucker rods and induce up and down reciprocating movement of pump apparatus components. In the prior art, fluid is lifted to the surface by successive upstrokes of the pump apparatus induced by the pump driver and transmitted by the string of sucker rods. The present invention provides a highly efficient pumping apparatus for moving fluid up a well from an underground production zone to the surface, utilizing not only energy provided by the pump driver, but also energy available from the action of gravitational acceleration upon pump components and sucker rods associated with the pumping apparatus.

The pumping apparatus of the invention includes an elongate hollow cylindrical body smaller in cross-sectional dimension than the casing of the well in which the pump apparatus is to be used. The lower end of the body is provided with a fluid inlet valve, such as a ball valve, that allows fluid to flow into the interior of the apparatus through the valve while preventing flow of fluid from the interior of the body. The upper end of the body includes perforations in the side wall, forming passages for flow of fluid from the interior of the body to the well casing. The body is connected at its upper end to production tubing extending to the surface, with the interior of the body in communication with the interior of the tubing.

The apparatus further includes a plunger assembly disposed within the interior of the body. The plunger assembly generally comprises a first cylindrical piston slightly smaller in diameter than the diameter of the body, and a second piston or shaft of substantially smaller diameter coaxially aligned with the first piston and extending outward from the upper end of the first piston. An elongate central aperture extends through both first and second pistons along their aligned longitudinal axes. The upper end of the second piston is connected to a string of sucker rods extending through the interior of the production tubing so that the plunger assembly can be moved up and down relative to the body by movement of the sucker rods. A fluid control valve is provided at the lower end of the first piston to allow fluid to flow from the interior of the body into the central aperture but prevent backflow of the fluid. Another fluid control valve is provided at the upper end of the second piston to allow fluid to flow from the central aperture into the production tubing, while preventing backflow from the tubing into the aperture. Sealing means are provided between the outer surface of the first piston and the wall of the body to form a fluid tight sliding seal and effectively divide the body into a lower chamber, below the sealing means, and an upper chamber. Additional sealing means is provided between the second piston and the transition between body and production tubing, to seal the upper chamber of the body from the tubing. The second piston performs the functions of transmitting reciprocal driving force to the first piston, conveying fluid to the production tubing, and assisting in sealing the upper end of the body from the interior of the production tubing.

The sealing means of the invention includes two groups of resilient packing material disposed between the respective piston and the pump body, with the two groups separated from each other to form an annular space that is filled with a lubricant material. Each group of packing material is maintained under compressive force by a tension spring, causing the resilient packing to expand laterally and maintain a secure seal between piston and body over an extended operational period. The packing material may be in any convenient form, such as discrete rings or coils, suitable for the intended use.

With the unique design of the pumping apparatus of the invention, production of fluid from the well is achieved by utilizing the force produced by the effect of gravity acting on the mass of the plunger assembly and the string of sucker rods, on the downstroke of the pump. Conventional reciprocating pumps produce fluid by using the upstroke of the pump to lift fluid up the production tubing. Consequently, the pump driver at the surface must provide sufficient power to not only lift the weight of the plunger and sucker rod string, but also to lift the weight of the column of fluid in the production tubing. With the pump of the invention no fluid is lifted on the upstroke, so the power requirements for the pump driver are substantially reduced. Further, the power utilized to lift the plunger assembly and sucker rods through the upstroke is regained on the downstroke.

On the upstroke of the pumping apparatus of the invention, the fluid control valves of the plunger assembly are closed and a partial vacuum is produced in the lower chamber of the body, so that fluid flows from the well casing into the body through the inlet valve. When downstroke begins the inlet valve of the body closes and the control valves of the plunger assembly open. Downward movement of the first piston displaces the fluid in the lower chamber of the body through the lower plunger assembly control valve into the central aperture, through the central aperture to the upper end of the second piston, through the upper plunger assembly control valve, and up the production tubing to result in production of a volume of fluid at the surface equal to the displacement of fluid from the lower body chamber. As upstroke begins the control valve operation immediately reverses, preventing backflow of fluid through the apparatus, and allowing the sucker rod string and upper portion of the second piston above the second sealing means to move through the fluid in the production tubing without obstruction. The perforations in the upper chamber of the body allow pressure equalization between the upper chamber and the well casing as the plunger assembly moves up and down.

The structure and features of the invention will be described in more detail below, with reference to the accompanying drawing figures.

DETAILED DESCRIPTION OF THE PREFERRED EMBODIMENT

Figure 1:
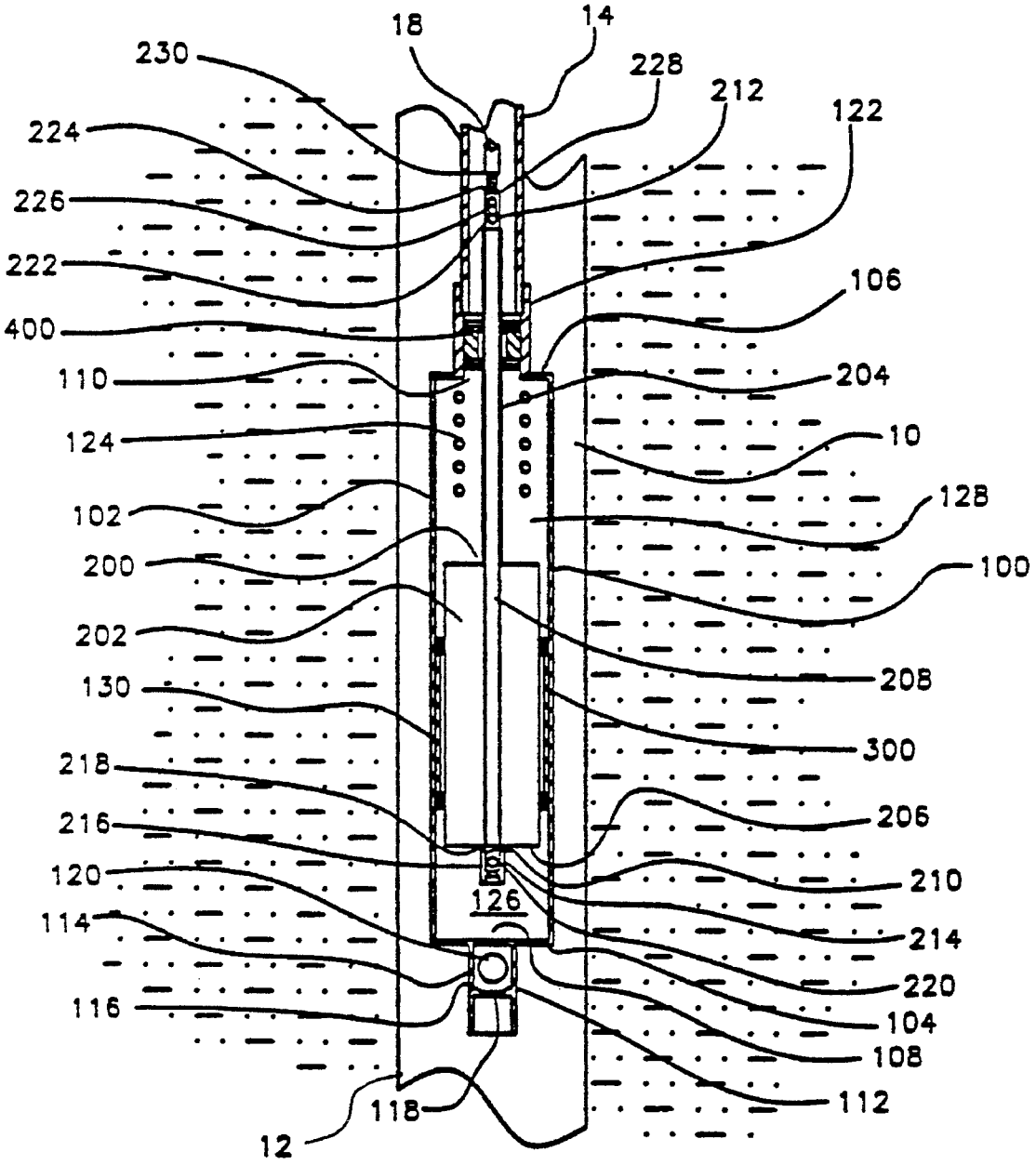
FIG. 1 is a longitudinally sectioned side elevation view of the preferred embodiment of the apparatus of the invention disposed in a well casing.

Referring to FIG. 1, the pumping apparatus of the invention, generally designated by reference numeral 10, will be seen to include a body 100, a plunger assembly 200, a barrel sealing assembly 300, and a neck sealing assembly 400. Apparatus 10 is intended to be disposed below the surface of the ground in a well bore, typically completed with a casing 12, with the body connected to a string of hollow production tubing 14 and at least partially submerged in standing fluid to be produced from the well.

Body 100 comprises an elongate hollow cylindrical barrel having a side wall 102, an annular bottom closure plate 104, and an annular top closure plate 106. The annulus of the bottom closure plate surrounds a fluid inlet aperture 108, and the annulus of the top closure plate surrounds aperture 110. Fluid inlet nipple 112, a hollow open ended nipple, is connected to bottom closure plate 104 around aperture 108 and extends outwardly from plate 104. In the preferred embodiment inlet nipple 112 functions as a valve body for an inlet valve 114 and includes annular valve seat 116 extending inward from the inner surface of nipple 112 around fluid passage 118. Ball 120 is disposed in the interior of nipple 112 between valve seat 116 and bottom closure 104, and is configured to close passage 118 when received against valve seat 116. Bottom closure plate 104 functions as a retainer for ball 120, and aperture 108 is preferably configured to allow the flow of fluid around ball 120 with ball 120 against bottom closure plate 104. Body 100 further includes hollow open ended neck 122 interconnected to top closure plate 106 around aperture 110 and extending upwardly therefrom. The upper end of neck 122 is adapted for connection to production tubing 14. The upper portion of side wall 102 is penetrated by a plurality of perforations 124.

Figure 2:
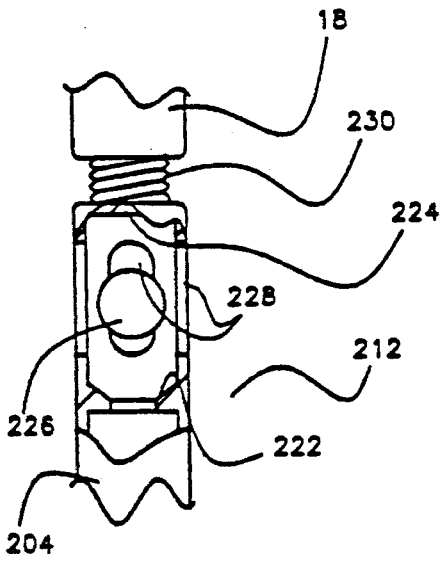
FIG. 2 is a partially sectioned side elevation detail view of the upper fluid flow control valve of the plunger assembly of the preferred embodiment of the apparatus of the invention.

Plunger assembly 200 generally comprises an elongate first piston 202, preferably cylindrical in configuration and slightly smaller in cross-sectional dimension than body 100, disposed in the interior of body 100, and an elongate second piston 204 coaxially aligned with and interconnected to the upper end of first piston 202. First piston 202 includes lower face 206. Pistons 202 and 204 are penetrated by continuous elongate fluid aperture 208 extending fully through both pistons in coaxial alignment therewith. Plunger assembly 200 also includes a lower fluid flow control valve 210 and an upper fluid flow control valve 212. Lower control valve 210 is similar in configuration to inlet valve 114 and includes valve body 214, formed as a hollow open ended nipple, interconnected to and extending outward from lower face 206 in coaxial alignment with fluid aperture 208, and having lower annular seat 216 and upper retainer 218 with ball 220 disposed between. Upper fluid flow control valve 212, illustrated in FIG. 2, is provided at the upper end of second piston 204, and similarly includes lower annular seat 222, upper retainer 224, and ball 226 disposed between. Upper valve 212 also includes fluid outlet slots 228 through which fluid may flow through the valve to the interior of production tubing 14. Connector stud 230 extends upwardly from the upper end of fluid flow control valve 212 for connection of plunger assembly 200 to a string of sucker rods 18. It is preferred that the cross-sectional dimension of second piston 204 be approximately equal to the cross-sectional dimension of sucker rods 18, so that no fluid is lifted by second piston 204 up the production tubing on upstroke of plunger assembly 200 and resistance to upward movement of second piston 204 through fluid in the production tubing is essentially eliminated.

Plunger assembly 200 is sealed against body 100 by barrel sealing assembly 300, disposed between the barrel of body 100 and first piston 202, and by neck sealing assembly 400, disposed between neck 122 of body 100 and second piston 204. Sealing assemblies 300 and 400, which form fluid fight sliding seals, are essentially identical in structure, and the following description of sealing assembly 300 will be understood to apply to sealing assembly 400 and to components thereof unless otherwise specifically noted.

Figure 3:
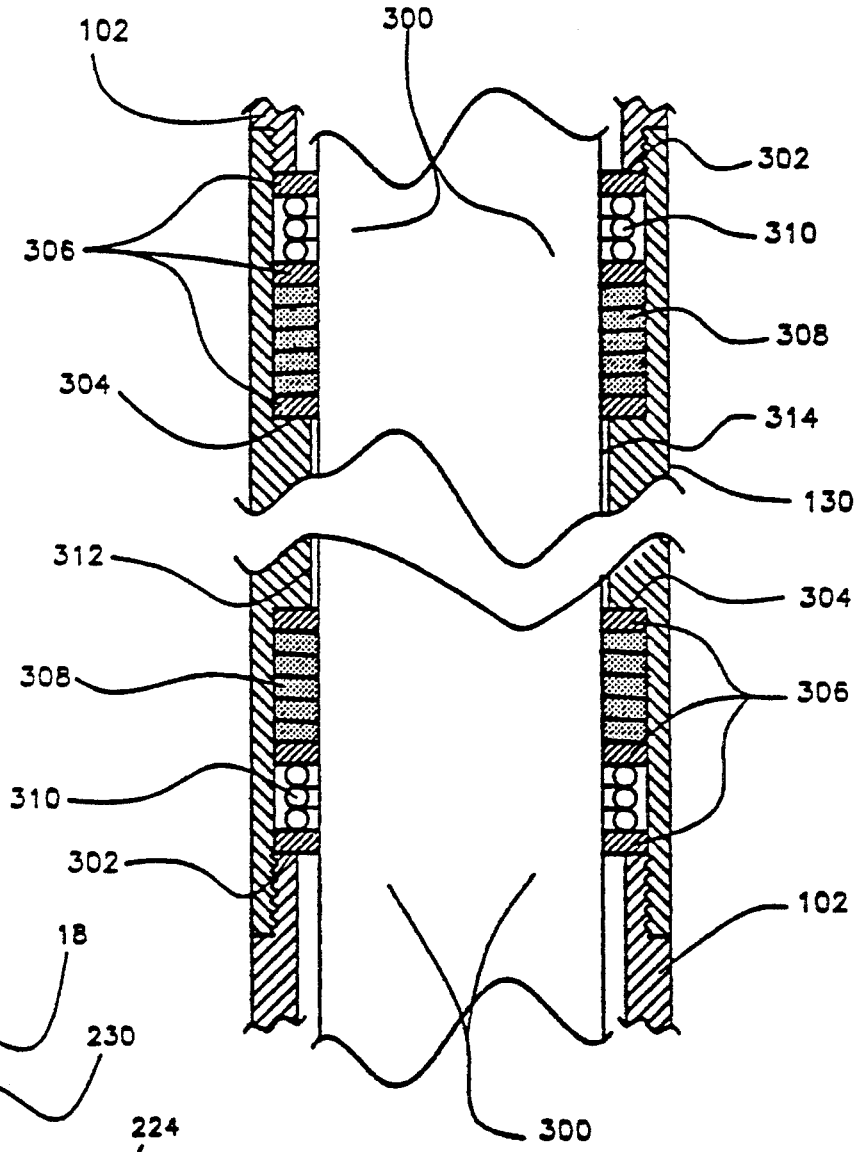
FIG. 3 is a sectioned side elevation detail view of the preferred embodiment of the sealing means of the invention.

Referring to FIG. 1, the barrel of body 100 is divided laterally into three segments, a lower chamber 126 between bottom closure 104 and the lower portion of first piston 202, an upper chamber 128 between top closure 106 and the upper portion of first piston 202, and stuffing box 130 associated with sealing assembly 300. As illustrated in FIG. 3, the segments are preferably joined by threaded connections formed in side wall 102, and the thickness of wall 102 in stuffing box 130 is thinned in the area of the threaded connections to form outer retaining ledge 302 and inner retaining ledge 304. In the preferred embodiment a first retaining ring 306 is disposed against ledge 302, followed by a compression spring 310, a second retaining ring 306, resilient packing material 308, and a third retaining ring 306 disposed against ledge 304. It is preferred that retaining rings 306 be of brass and that packing material 308 be in the form of a coil of Kevlar® material, though other materials may be used if desired. Compression spring 310 compensates for packing wear by maintaining a constant force acting to compress the packing material and force the packing material against the piston. Although it is preferred that a spring 310 be provided at each end of sealing means 300, spring 310 may be omitted from one end if desired. It is further preferred that compression spring 310 be a coil spring, though it will be understood that any suitable compression spring design may be used.

Figure 4:
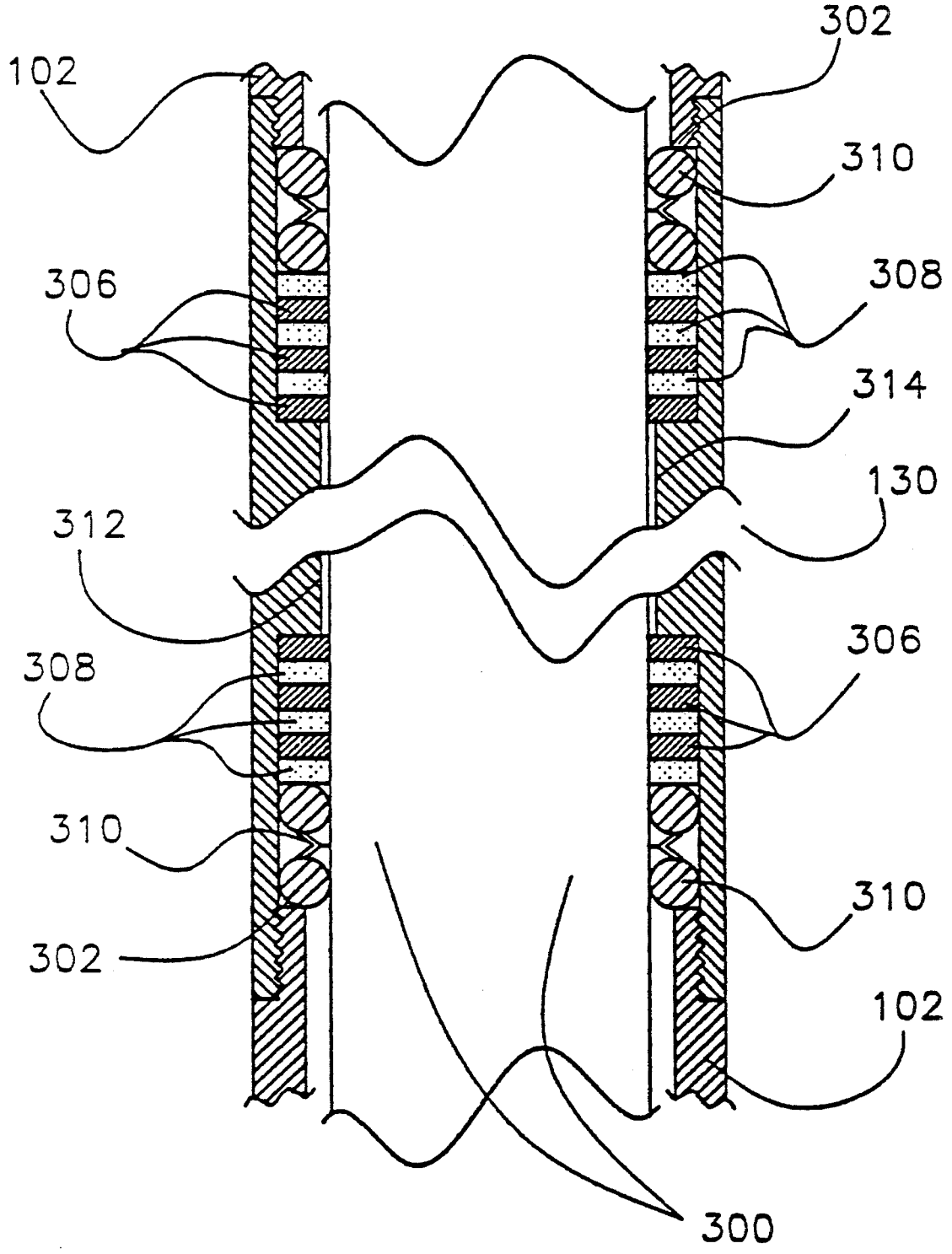
FIG. 4 is a sectioned side elevation detail view of an alternative embodiment of the sealing means of the invention.

Referring to FIG. 4, an alternative embodiment of the sealing assemblies 300 and 400 is shown and is again described in connection with the sealing assembly 300. In this alternative embodiment, the coil of packing material 308 is replaced by discrete rings of packing material 308, alternating with additional retaining rings 306, and the first and second retailing rings 306 and the coil spring embodiment of compression spring 310 are replaced by a compression spring 310 with integral retainer rings. Any combination of the preferred and alternative embodiments specifically disclosed may be used, or other packing and retaining arrangements suitable for the intended purpose may be used within the scope of the invention.

In both embodiments, the upper and lower portions of sealing means 300 are separated by an annular space 312 which is preferably filled with a lubricant 314. Lubricant 314 is retained by rings 306 and packing 308, and serves to reduce friction between pistons 202 and 204 and the respective sealing means for efficient operation and reduced component wear. Though lubricant 314 serves a useful function, it may be omitted without departing from the scope of the invention. Over a period of operation of the pumping apparatus the movement of plunger assembly 200 relative to body 100 against the packing rings of the sealing assemblies will cause wear of such packing rings and eventually failure of the sealing assemblies. In addition to the reduction in the rate of wear achieved by the use of lubricant 314, the compressive force imposed on the packing rings by springs 310 produces a lateral expansion of the rings against the respective piston surface, further extending the useful life of the sealing assembly components and reducing maintenance requirements.

Because it utilizes the force produced by the action of gravity on the combined mass of plunger assembly 200 and the string of sucker rods 18, pump apparatus 10 is highly efficient in operation. When prepared for use, pumping apparatus 10 will be disposed and conventionally supported in a well casing, with both production tubing and sucker rods connected to the apparatus and extending to the surface. A pump driver (not shown in the drawing figures) is used to produce reciprocal, up and down, movement of the sucker rods and thus of the plunger assembly of the apparatus of the invention. In preparation for pump operation the lower chamber 126 of apparatus 10 should be free of air or other gas to prevent "gas lock".

On the upstroke of the pumping action, plunger assembly 200 of apparatus 10 is raised relative to body 100, increasing the volume of lower chamber 126 and decreasing the volume of upper chamber 128. On the upstroke lower and upper fluid flow control valves 210 and 212 are closed and fluid inlet valve 114 is open. As the volume of lower chamber 126 is increased, a partial vacuum is created, including the flow of fluid into lower chamber 126 from the well casing through fluid inlet valve 114. Upon completion of the upstroke, lower chamber 126 is full of fluid to be produced from the well. As downstroke is initiated, fluid flow control valves 210 and 212 open and inlet valve 114 closes. Through the downstroke the volume of lower chamber 126 is reduced and the volume of upper chamber 128 is increased. The downstroke movement of first piston 202 in lower chamber 126 increases pressure on the fluid in lower chamber 126, causing it to flow through lower fluid flow control valve 210 into central aperture 208, through aperture 208 and upper fluid flow control valve 212, and into production tubing 14. Introduction of the volume of fluid displaced by first piston 202 into production tubing 14 immediately above apparatus 10 causes a simultaneous production of the same volume of fluid at the surface. Upper chamber 128 of the barrel of body 100 is isolated from both lower chamber 126 and production tubing 14, and perforations 124 allow the exchange of liquid and/or gas between the interior of upper chamber 128 and the well bore to equalize pressure during upstroke and downstroke.

Upon completion of downstroke and initiation of upstroke, fluid flow control valves 210 and 212 close and inlet valve 114 opens, for repetition of the described sequence. It will be understood that during upstroke the pump driver is required to lift only the weight of the sucker rods and plunger assembly. No fluid is lifted during upstroke. In deep wells the weight of the column of fluid in the production tubing is substantial, and the work required to lift that column is also substantial. On downstroke of the apparatus of the invention, the potential energy stored by elevation of the sucker rods and plunger assembly is converted to kinetic energy and used to force fluid to the surface, utilizing the energy expended during upstroke less only frictional losses. By comparison, conventional pumping apparatus performs pumping "work" only on the upstroke and the downstroke serves only to "reset" the pumping apparatus for another production upstroke.

The foregoing description of the preferred embodiment of the pumping apparatus of the invention and of the method of fluid production utilizing the apparatus of the invention is illustrative and not for purposes of limitation. The apparatus and method are susceptible to various modifications and alternative embodiments in addition to those described, without departing from the scope and spirit of the inventions claimed.

What is claimed is:

1. A pumping apparatus comprising:

a hollow body having upper and lower openings;

a piston movably disposed within said body having an internal bore extending axially therethrough;

a hollow shaft extending from and connected to said piston for reciprocally driving said piston, said shaft defining a bore in fluid communication with said piston bore, thereby forming a fluid conduit extending through said piston and said shaft; and one-directional fluid control valves disposed at opposite ends of said fluid conduit for controlling flow through said fluid conduit, said pumping apparatus producing fluid on the downstroke as said shaft drives said piston downwardly.

2. The pumping apparatus of claim I further comprising sealing means disposed between said piston and said body for forming a fluid-tight seal therebetween, said piston thereby defining with said body upper and lower chambers.

3. The pumping apparatus of claim 2 wherein said body defining said upper chamber contains a plurality of perforations extending therethrough for pressure equalization.

4. The pumping apparatus of claim 2 further comprising a one-directional fluid control valve disposed at said lower opening of said body for controlling flow into said lower chamber.

5. The pumping apparatus of claim 2 wherein said sealing means comprises resilient packing material maintained under compressive force by a tension spring.

6. The pumping apparatus of claim 5 wherein said packing material is formed in a coil.

7. The pumping apparatus of claim 5 wherein said packing material comprises a plurality of discrete rings.

8. The pumping apparatus of claim I wherein said shaft extends through said upper opening of said body, said pumping apparatus further comprising:

a neck member extending upwardly from said upper opening of said body for receiving said shaft; and sealing means disposed between said shaft and said member for forming a fluid-tight seal therebetween.

9. The pumping apparatus of claim i further comprising a plurality of rods extending upwardly from said shaft for reciprocally driving said shaft.

10. The pumping apparatus of claim 9 wherein the cross-sectional dimension of said shaft is generally equivalent to the cross-sectional dimension of said rods.

11. The pumping apparatus of claim 9 wherein said rods are weighted for providing additional driving force.

12. A method of pumping fluid from a well through a string of hollow production tubing by means of a reciprocating pump disposed in the well, comprising the steps of:

forming a chamber in said pump for receiving said fluid through a first one-directional fluid control valve;

sealingly disposing a piston within said chamber for reciprocal movement therein between lower and upper positions, said piston having an internal bore extending axially therethrough in fluid communication with a bore of a hollow shaft extending upwardly from said piston through a fluid seal into said production tubing, said bores forming a fluid conduit having second and third one-directional fluid control valves at opposing ends for controlling the flow of said fluid through said fluid conduit;

moving said piston from said lower position to said upper position by raising a plurality of rods extending from said shaft to the surface of said well, thereby decreasing the pressure within said chamber and urging said fluid to fill said chamber via said first one-directional fluid control valve; and moving said piston from said upper position to said lower position by lowering said rods, thereby increasing the pressure within said chamber and urging said fluid in said chamber to flow through said fluid conduit into said production tubing via said second and third one-directional fluid control valves, thereby producing said fluid on the downstroke of said pump.

13. The method of claim 12 further comprising the step of providing additional downward driving force to said piston by weighting said rods.

14. The method of claim 12 wherein the diameter of said shaft is generally equivalent in size to the diameter of said rods.

* * * * *